US005937881A

United States Patent [19]

Villa

[11] Patent Number: 5,937,881

[45] Date of Patent: Aug. 17, 1999

[54] ADJUSTABLE SHADOW CASTING SHADE UMBRELLA AND STAND

[76] Inventor: Mike Villa, 329 E. College St., Covina, Calif. 91723

[21] Appl. No.: 08/998,113

[22] Filed: Dec. 24, 1997

[51] Int. Cl.[6] ..... A45B 11/00

[52] U.S. Cl. ..... 135/20.1; 135/16; 135/21; 135/88.04; 135/98; 135/135; 135/155; 403/90; 248/288.51; 248/281.11; 248/188.2

[58] Field of Search ..... 135/20.1, 20.3, 135/21, 23, 98, 155, 88.04, 16, 124, 117; 403/56, 90, 103, 180; 248/276.1, 276.11, 288.51, 281.11, 188.2, 188.7, 545, 288.31

[56] References Cited

U.S. PATENT DOCUMENTS

| | | | |
|---|---|---|---|
| 581,691 | 5/1897 | Buchanan et al. | 135/124 X |
| 923,542 | 6/1909 | Losey | 135/20.1 X |
| 2,650,788 | 9/1953 | Hulstein | 248/288.51 X |
| 3,304,035 | 2/1967 | Davis | 135/20.1 X |
| 4,307,864 | 12/1981 | Benoit | 248/288.31 X |
| 4,836,231 | 6/1989 | Peterson | 135/98 |
| 5,033,528 | 7/1991 | Volcani | 403/56 X |
| 5,611,364 | 3/1997 | Woods et al. | 135/23 X |
| 5,641,191 | 6/1997 | Jia | 248/288.51 X |
| 5,645,253 | 7/1997 | Hoshino | 248/288.31 X |

FOREIGN PATENT DOCUMENTS

| | | | |
|---|---|---|---|
| 192335 | 11/1964 | Sweden | 135/20.1 |
| WO 89/09589 | 10/1989 | WIPO | 135/98 |

*Primary Examiner*—Carl D. Friedman
*Assistant Examiner*—Winnie S. Yip
*Attorney, Agent, or Firm*—Curtis L. Harrington

[57] ABSTRACT

A shading device includes an abbreviated height umbrella having a articulating ball attachment structure on both its upper and lower sides and attached to a pivoting arm through a series of universal connectors and joints having spherical articulating balls secured in articulating ball joints with tension force provided by joint retention screws. The umbrella can be either supported from the bottom or suspended from the top, to provide maximum articulation. A tripod folding stand has a body having an upper ribbed member for engagement with the clamp, and a series of three legs pivotally attached at an upper portion of the body and struts attached at a lower portion between the legs and body. The ends of the legs have pivotal spikes which can be pivoted to an open direction and directed into dirt or sand or other material, or used as hold down extensions.

16 Claims, 6 Drawing Sheets

ADJUSTABLE SHADOW CASTING SHADE UMBRELLA AND STAND

FIELD OF THE INVENTION

This invention relates to an extremely portable, highly adjustable, highly adaptable device for shading either a portion of a person, another device, or an area to be protected from light or heat and which may be supported from a lawn chair, patio/pool furniture or other like structures.

BACKGROUND OF THE INVENTION

Shading structures are generally well known, come in a wide variety of shapes, sizes and weights to meet a corresponding wide variety of applications. However each shape and size will generally relate only to a narrow number of equivalent applications. In most cases when shade is needed an appropriate structure will not be available. Conventional umbrellas usually have no attachment structures, and complex shade structures are bulky and difficult to transport, even where such complex structures are available.

The main problems encountered involve the availability of the space immediately around the object or area to be shaded. For example, an umbrella with a straight stake must be thrust into the ground at least near the object to be shaded. For a given size umbrella, or shade structure, the support stake may be such that the umbrella has to be held at an awkward angle in order to both garner sufficient support and yet provide shade to the target area.

One problem relates to the ability to provide an articulating support which provides a stable configuration for the device. Another problem relates to the inability to support the shading structure from more than one side of its structure. Another problem relates to the ability of a shading structure to gather sufficient support with the proper orientation to provide sufficient shading. Another problem relates to the ability to bring the shading structure close to the area to be shaded but to avoid, to the extent selected, contact with the structure to be shaded. Another problem is the inability to take advantage of the widest variety of support structures which may be available at the time and place where the shading structure is needed. Another problem is the inability to utilize the ground upon which the shading structure is supported without digging large, deep, ugly holes in the ground, disrupting the ground cover.

SUMMARY OF THE INVENTION

A shading device includes an abbreviated height umbrella having a sandwich ball joint attachment structure on both its upper and lower sides. The shading device is attached to a pivoting arm through a series of support arms having spherical articulating balls secured in sandwich ball joints having articulating ball retention plates with tension force provided by joint retention screws. Thus the umbrella can be either supported from the bottom or suspended from the top, to provide maximum articulating utilization. The umbrella structure includes an assembly retaining clip hub having an upper articulating ball, a middle structure configured to support folding ribs, and a lower pinch clip portion. Attached to the folding ribs are rib extenders which connect to an extender assembly receptacle having an upper structure configured to support the folding ribs, and which has a split aperture to accommodate the pinch clip portion of the assembly retaining clip hub while limiting the inward angular displacement of the pinch clip. The extender assembly receptacle has a middle support portion and a lower articulating ball end. The end of the articulating support opposite its connection to one of the articulating balls of the umbrella member includes a high tension clamp for attachment to any convenient object. A tripod folding stand has a body having an upper ribbed member for engagement with the clamp, and a series of three legs pivotally attached at an upper portion of the body and struts attached at a lower portion between the legs and body. The ends of the legs have pivotal spikes which can be pivoted to an open direction and directed into dirt or sand or other material, or used as hold down extensions.

BRIEF DESCRIPTION OF THE DRAWINGS

The invention, its configuration, construction, and operation will be best described in the following detailed description, taken in conjunction with the accompanying drawings in which.

DETAILED DESCRIPTION OF THE PREFERRED EMBODIMENT

Figure 1:
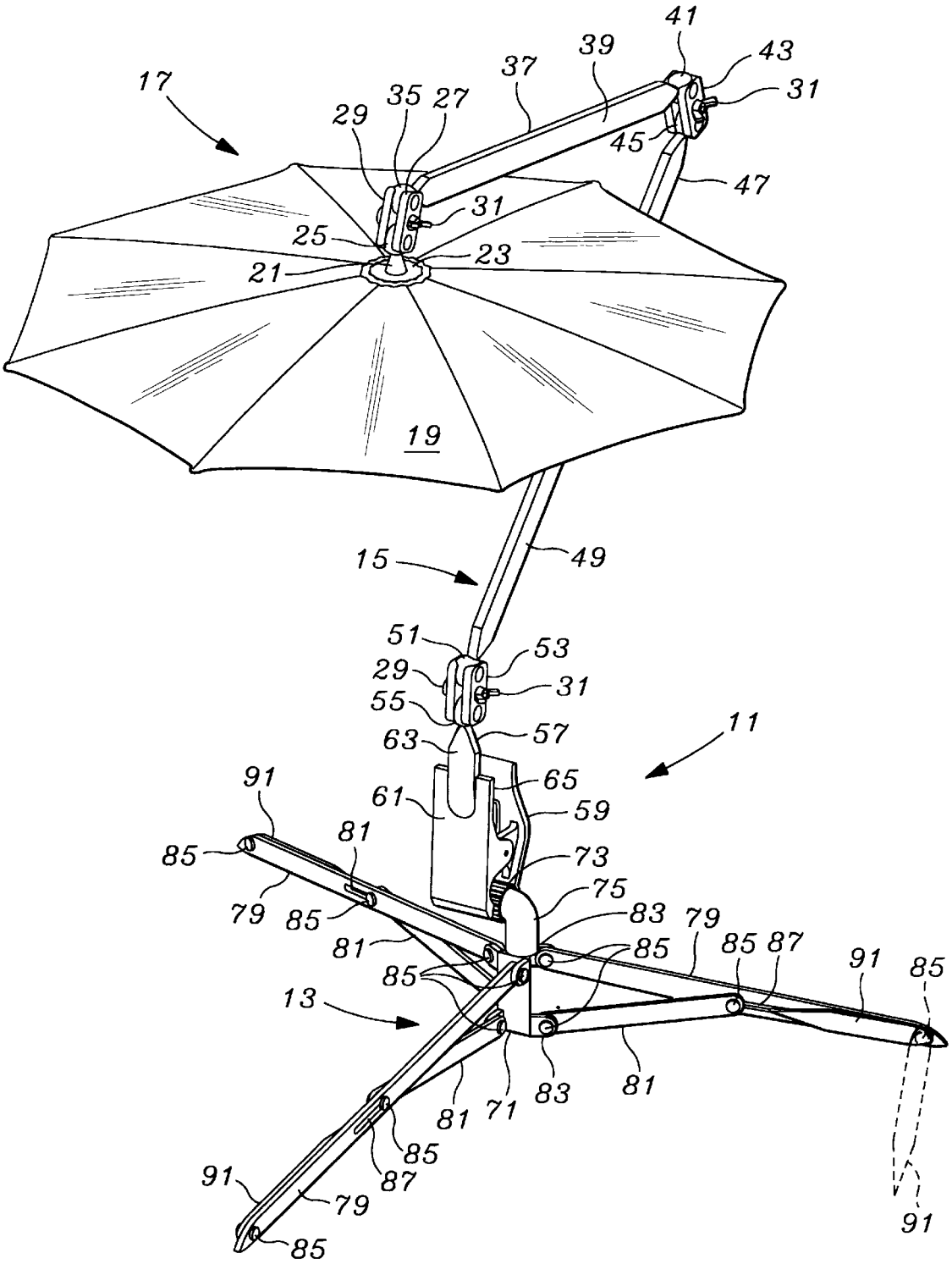
FIG. 1 is a perspective view of the structure of the invention including expanded tripod base with clamp attached, articulating arm and suspended umbrella structure.

Referring to FIG. 1, an integrated shading structure 11 is shown, including a tripod stand 13, an articulating clamping arm 15, and an umbrella structure 17.

Beginning at the upper part of FIG. 1, the umbrella structure 17 has a light blocking material surface 19 which is preferably a cloth material fitted over a support structure to be shown. The material surface 19 surrounds an assembly retaining clip hub 21 having a rib support structure 23 and an upper articulating ball 25. Further details of the underside of the umbrella structure 17 will be discussed in further drawings.

The upper articulating ball 25 is secured by a first set of articulating ball retention plates 27. The center of the plates 27 each have an aligning bore through which a joint retention screw 29 engages a wing nut 31. The expanded head portion of the joint retention screw 29 can be seen in FIG. 1. The tightening and loosening of the wing nuts 31 and retention screws 29 control the collapse and erection of the integrated shading structure 11. When loosened, the articulating clamping arm 15 and umbrella structure 17 can be folded to a small size and stored. During deployment, the tightening process will be performed sufficient to enable the shading structure 11 to maintain its position as it is being set up.

In addition to the upper articulating ball 25, the articulating ball retention plates 27 also engage a articulating ball 35 of a first universal arm 37. Universal arm 37 has a flat side surface 39 seen in FIG. 1, and terminates in a articulating ball 41. A second set of articulating ball retention plates 43 are seen as also having a joint retention screw 29 and wing nut 31, securing articulating ball 41 and a articulating ball 45 of a second universal arm 47. Universal arm 47 also has a flat side surface 49, and terminates in a articulating ball 51. A third set of articulating ball retention plates 53 are seen as also having a joint retention screw 29 and wing nut 31, securing articulating ball 51 and a articulating ball 55 of a clamp 57.

The clamp 57 has a curved first pivoting member 59 which pivots with respect to a relatively flatter second pivoting member 61. At the rearward end of the member 61 a transition member 63 is connected to the articulating ball 55. The clamp 57 has grasping area which, although it conforms to the surface engaged o the tripod stand 17, can be engaged on any number of available surfaces. In particular, the clamp 17 can clamp onto lawn chairs, patio furniture, coolers, fences, limbs, sticks and edges of all types. A high tension spring 65 between the first and second pivoting members 59 and 61 gives good support to the articulating clamping arm 15 and umbrella structure 17 it supports.

The tripod stand 13 has a short vertical body 71 which has a horizontal, circumferentially ribbed cylindrical member 73. In the embodiment shown, the member 73 lies to one side of a curving transition support 75. The body 71 has an upper extent which is pivotally connected to a series of three legs 79. The body 71 has a lower extent which is pivotally connected to a series of three retaining arms 81. As can be seen, each set of a leg 79 and an arm 81 is mounted to fold past each other. Pivotal dependence of the leg 79 and arm 81 is through an outwardly extending tab 83. The tabs 83 are arranged, for each set of a leg 79 and 81, to lie horizontally outside the set. This precludes interference between either of the leg 79 or arm 81 with the tabs 83. In addition, for each set of a leg 79 and arm 81, the spacing is sufficient to permit an angled separation between the leg 79 and arm 81, to insure that there is no interference between them and that they can fold to an aligned orientation. Pivotal connection between the tabs 83 and the arms 81 and legs 79 is by rivet 85.

Each leg 79, relatively near the central extent length, carries an elongate slot 87. The outer ends of the arms 81 also have rivets 85 but which extend through apertures in the ends of arms 81 and through the elongate slot 87 of the leg 79 to join and allow the end of arm 81 to translate the length of the elongate slot 87. This automatically limits the upper extent of pivot of the leg 79 with respect to the body 71 of the tripod stand 13, the body 71, leg 79 and arm 81 forming a stable triangular configuration when the leg 79 is at its upper extent.

Also seen in FIG. 1 and partially obscuring one of the elongate slots 87 is a pivoting pointed stake 91 which is pivotally attached by rivet 85 to the end of the leg 79. In normal use, the stake 91 lies alongside the leg 79. Where the stake 91 is smaller or the same width as the leg 79, it occupies no significant additional space and is barely noticeable, blending in with the general shape of the leg 79. Generally, the stake 91 can be pivoted 360° with respect to the leg 79.

Figure 2:
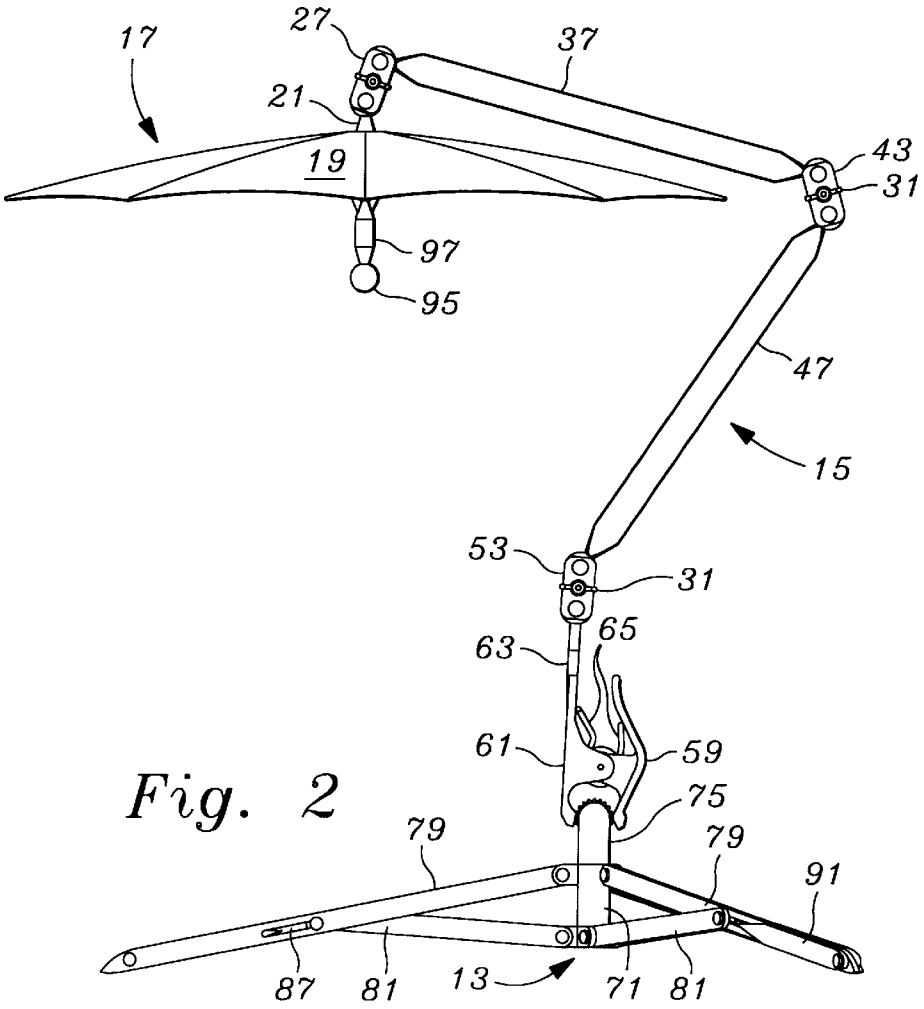
FIG. 2 is a side view with the umbrella structure attached in suspended position as was shown in FIG. 1.

Referring to FIG. 2, a reduced side view of the shading structure 11 seen in FIG. 1 exposes partially the underside of the umbrella structure 17 and a lowermost articulating ball 95 depending from a short structural member 97. As seen in FIG. 2, the umbrella structure 17 is suspended from the retention plates 27. The lowermost articulating ball 95 is handy to assist the user in angularly adjusting the umbrella structure 17.

Figure 3:
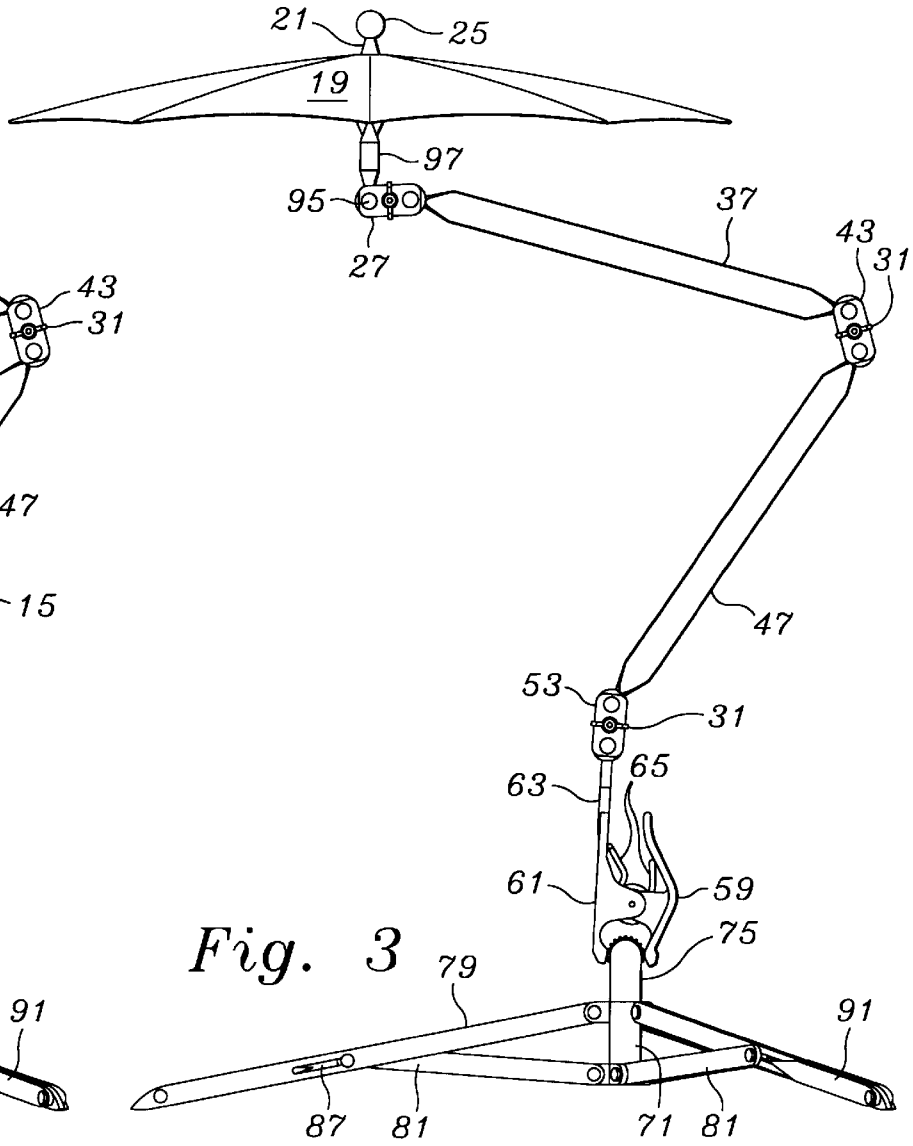
FIG. 3 is a side view as in FIG. 1, but shown with the umbrella member supported from its bottom.

Referring to FIG. 3, the lower articulating ball 95 is engaged with the retention plates 27, illustrating a bottom support configuration. This configuration also emphasizes the fact that the sets of retention plates 27, 43, and 53 can be completely disassembled if necessary for even further disassembly, as well as for packing for shipment. Many of the structures numbered and seen in FIG. 1 are not seen in FIGS. 2, & 3, for simplicity and since they are not emphasized in FIGS. 2 & 3.

Figure 4:
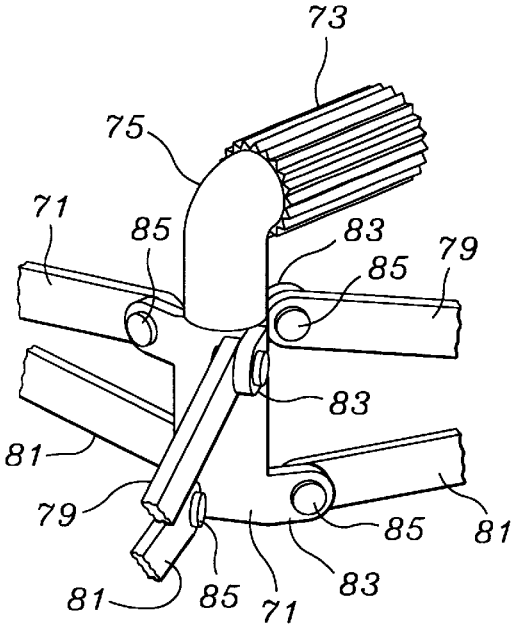
FIG. 4 is a closeup view of the main body of the tripod illustrating the grasping structure extending upward and to one side and the offset pivoting mounting of the tripod legs and the retaining arms.

Referring to FIG. 4, a close up perspective view of the body 71 of the tripod stand 13 illustrates the rivets and relative vertical and horizontal separation between the legs 79, and arms 71. The outside location of each pair of tabs 83 is also more readily shown.

Figure 5:
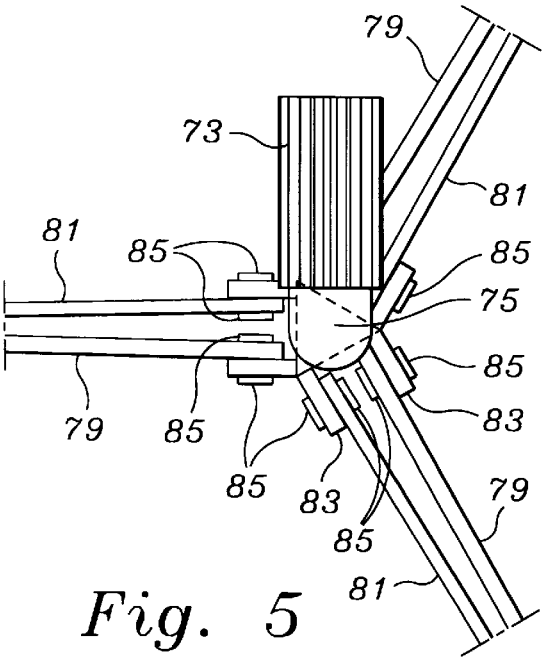
FIG. 5 is a top view of the tripod body seen in FIG. 4 and illustrating the separation of the tripod legs and the retaining arms to insure complete collapsible foldability.

Referring to FIG. 5, a top view of the tripod emphasizes the horizontal separation between the legs 79, and arms 71, as well as the clearance with respect to the outer portions of the rivets 85. The full horizontal extent of the circumferentially ribbed cylindrical member 73 is also seen.

Figure 6:
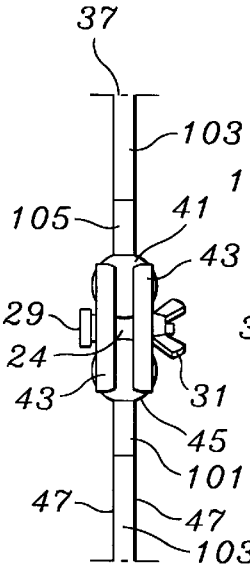
FIG. 6 is a top view looking down onto the articulating arm seen in FIG. 1 and which illustrates the removal of material from the sides to form a flattened surface which acts to save space and to provide a more easily observed visual surface.

Referring to FIG. 6, the joint between first and second universal arms 37 and 47 is shown in expanded view. This expanded view shows the transition between the wider portion of the second universal arm 47 and a taper 101. In essence, the geometry of the universal arm 47 is round, but with flattened sides, leaving a top and bottom surface which may preferably be curved. Surface 103 has a curved surface. From the taper 101 the curved surface becomes a curved conical surface along the taper 101. Note that the taper approaches a size at the point of transition into the articulating ball 45 which is equivalent to, or greater in magnitude than the width of the second universal arm 47 between flat side surfaces 47 seen on the opposite sides of the second universal arm 47. In other words, material can be removed from the sides of a universal arm 37, 47, but not to weaken it beyond the smallest cross sectional area connecting it with its respective articulating ball 25, 35, 41, 45, 51, 55, or 95.

In FIG. 6, some of the area of the articulating balls 41 & 45 are seen to extend beyond the ends of the second set of articulating ball retention plates 43. This is permissible since the articulating ball retention plates 43 contain a spherical section surface which is sufficient to capture and retain the articulating balls 25, 35, 41, 45, 51, 55, or 95, all of which are preferably of identical size, as are the retention plates 27, 43, & 53. In addition, abbreviating the length of the retention plates 27, 43 & 53 allows greater angular displacement of the articulating balls 25, 35, 41, 45, 51, 55, and 95 with respect to the retention plates 27, 43, & 53. First universal arm 37 is seen as having a curved surface 103 and a taper 105.

Figure 7:
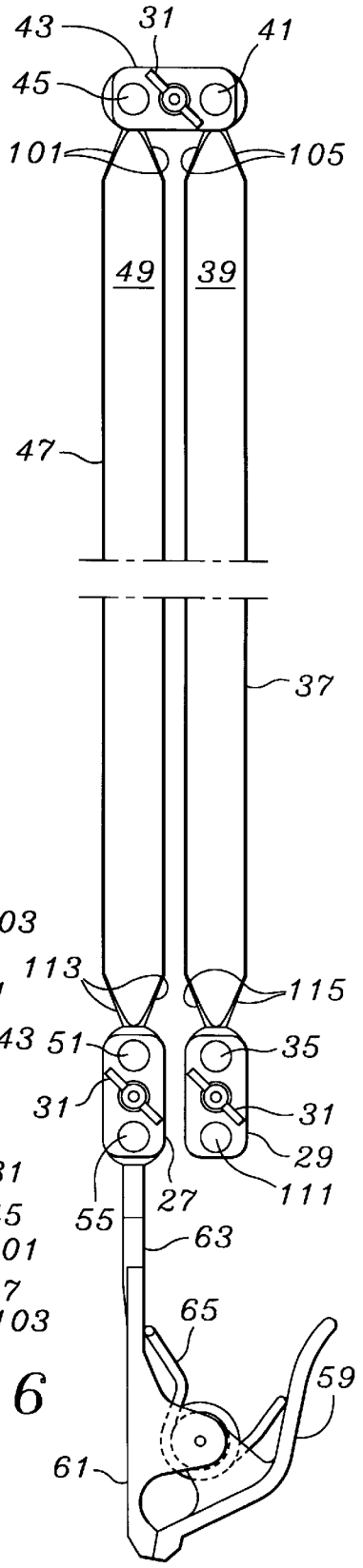
FIG. 7 is a side view of the articulating arm and clamp in collapsed position.

Referring to FIG. 7, the flat side surfaces 39 and 49 are more readily seen. The articulating clamping arm 15 is seen with the retention plates 27 disconnected from the upper articulating ball 25. Without the presence of the upper articulating ball 25, an aperture 111 is seen. Immediately about the inside of the aperture 11, the spherical section surface is formed, and which conforms to the spherical shape of the articulating balls 25 and 95 in order to give enough contact and friction that the articulating clamping arm 15 can secure its position against its own weight, and the weight of umbrella structure 17. Also seen are other tapering surfaces 113 and 115 which exist on opposite sides of the respective ends of second and first universal arms 47 and 37.

Figure 8:
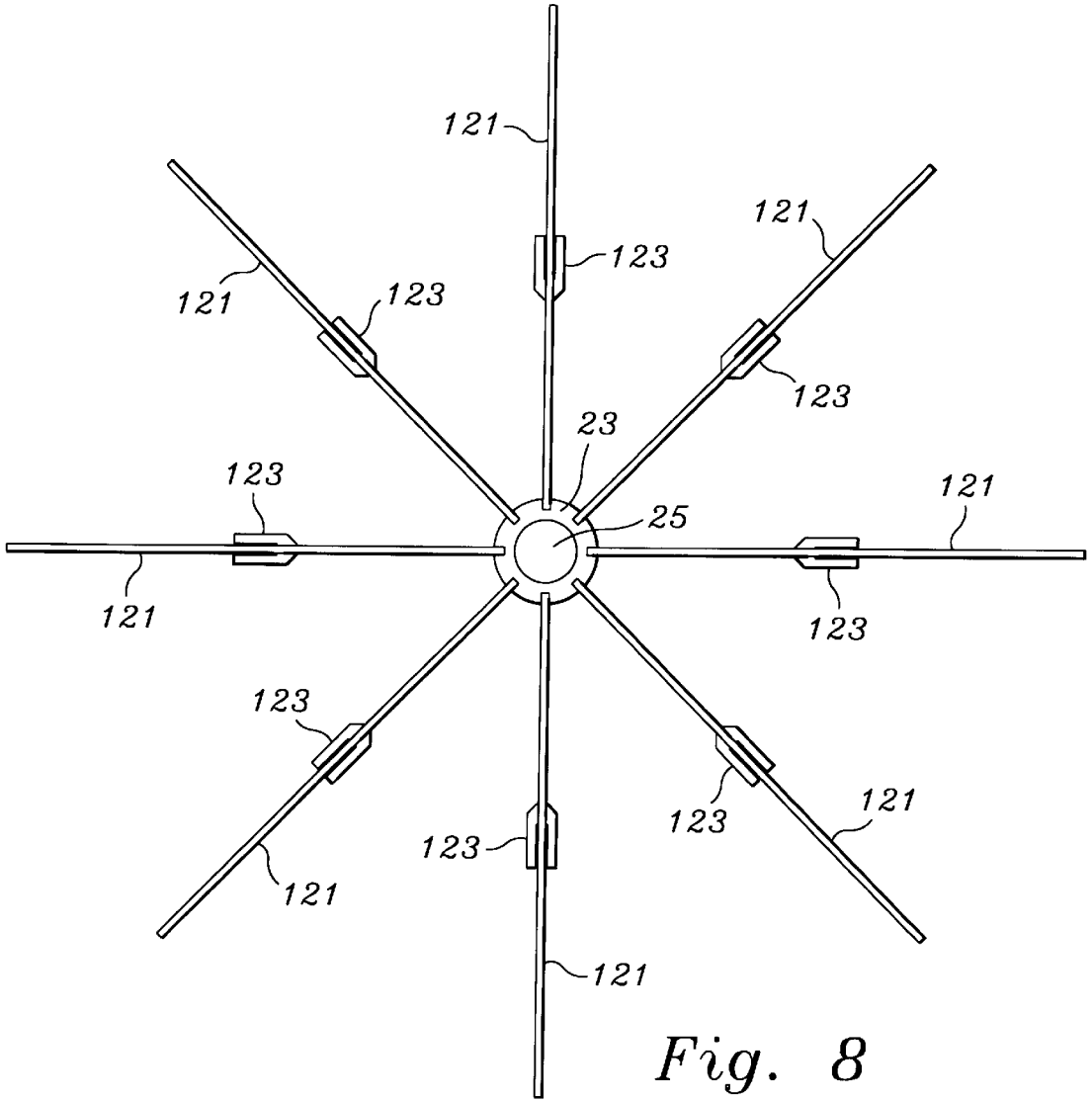
FIG. 8 is a top view of the umbrella assembly without the cloth covering and in which the top of the assembly retaining clip hub can be seen along with the upper articulating ball joint.

Referring to FIG. 8, a top view of the umbrella structure 17, with the light blocking material 19 removed illustrates a series of radially extending umbrella ribs 121. Below the ribs 121, only the fork end 123 of a series of umbrella rib extenders 125 can be seen. The attachment of the ribs 121 to the rib support structure 23 can also be seen, and the upper articulating ball 25 which sits atop structure 23. The ribs 121 are usually attached to the support structure by a ring or wire extending through bores in the ends of the ribs 121 and extending around the rib support structure 23.

Figure 9:
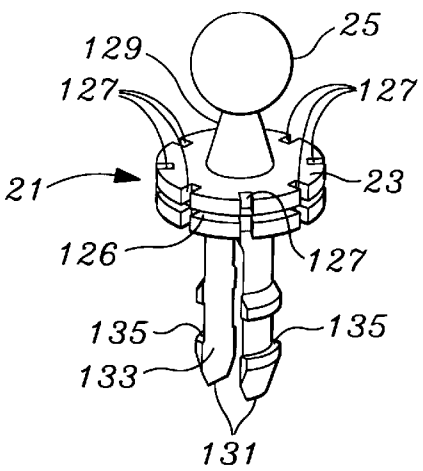
FIG. 9 is a perspective view looking down from the top of the assembly retaining clip hub.

Referring to FIG. 9, an upper perspective view of the assembly retaining clip hub 21 gives a better view of the rib support structure 23 as having a circumferential groove 126 which either lies radially within or is even with a series of radial grooves 127. Now best separately seen and identifiable is an intermediate portion 129 connecting the upper articulating ball 25 with the rib support structure 23.

Below the assembly retaining clip hub 21 is a pair of downwardly disposed spaced apart fingers 131 having oppositely inwardly disposed generally planar surfaces 133, and each having a upwardly directed ramped groove 135 for engaging a extender assembly receptacle to be shown in FIG. 10. Manually pinching the lower ends of the fingers 131 together moves the ramped grooves 135 will disengage the assembly retaining clip hub 21 from the extender assembly receptacle to enable the umbrella structure to fold shut.

Figure 10:
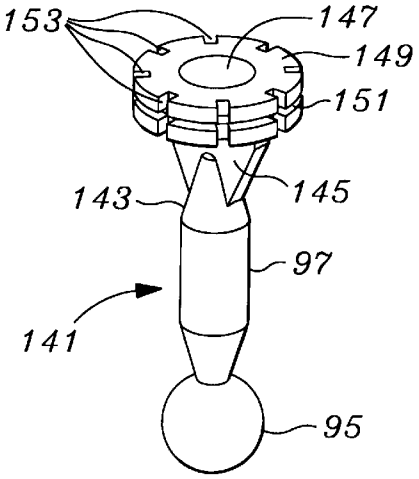
FIG. 10 is a perspective view looking down from the top of the extender assembly receptacle, and shown aligned with the assembly retaining clip hub of FIG. 9.

Referring to FIG. 10, as can be seen, the lowermost articulating ball 95 and short structural member 97 is part of a extender assembly receptacle 141. As it extends upward, short structural member 97 tapers to a conic portion 143 which transitions to a flat triangular structure 145. The flat triangular structure 145 is used to fit in between the fingers 131 of the assembly retaining clip hub 21 as the fingers 131 are fitted through an upper bore 147. When manually bringing the downwardly disposed spaced apart fingers 131 together, the inward displacement will be limited by the flat structure 145. As the downwardly disposed spaced apart fingers 131 exit through the upper bore 147, it moves out of reach of further application of force.

The extender assembly receptacle 141 has a rib support structure 149, and also has a circumferential groove 151, and a series of radial grooves 153. The circumferential groove 151 which either lies radially within or is even with the series of radial grooves 153, and these structures engage the ends of the umbrella rib extenders 125 in the same manner in which the rib support structure 23 engages the umbrella ribs 121.

Unlike conventional umbrellas which have its lower radially extending umbrella ribs on a lower ring and umbrella rib extenders on a second ring, but mounted to slide on the same pole or support to which the ribs is supported by, the disconnection of the extender assembly receptacle 141 from the assembly retaining clip hub 21 is accomplished through a space separation, but where the radially extending umbrella ribs 121 and umbrella rib extenders 125 will supply the stability to keep extender assembly receptacle 141 in alignment with the assembly retaining clip hub 21. A pole or other common support is not needed with the invention's design, and this is an important factor in its ability to fold to a small size.

Figure 11:
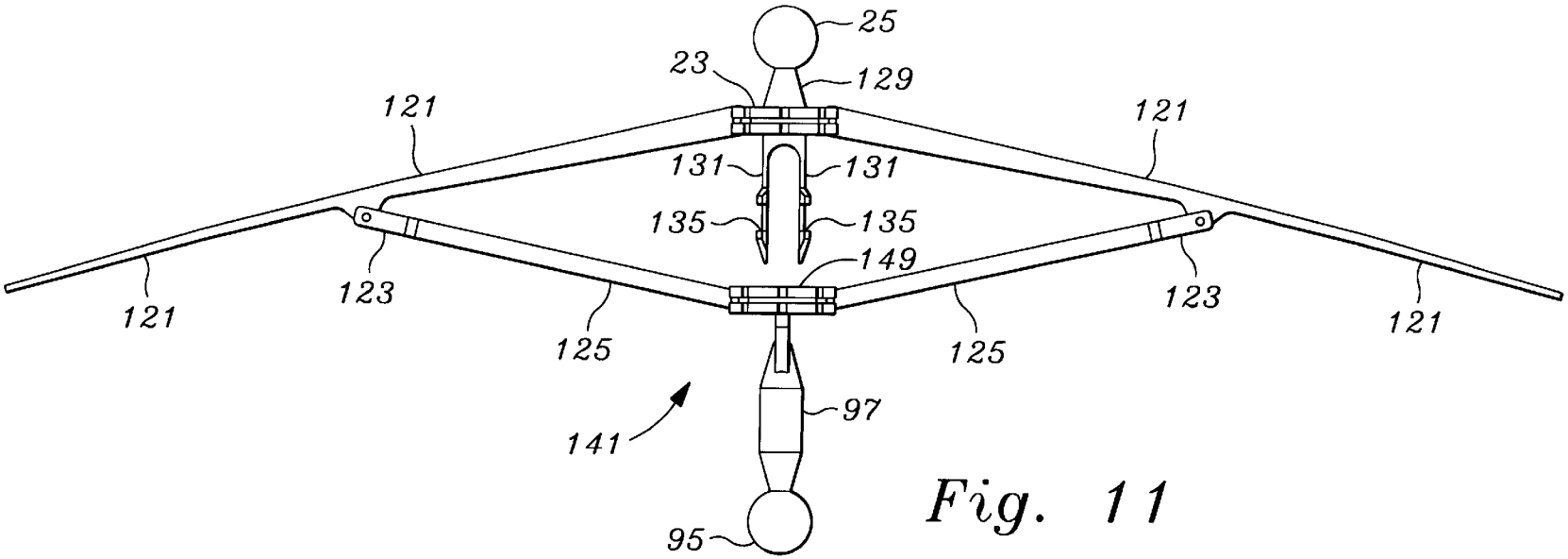
FIG. 11 illustrates a side view of the umbrella assembly seen in FIG. 8 in which the assembly retaining clip hub is shown as disconnected and slightly displaced away from the extender assembly receptacle and in which the umbrella ribs are slightly downwardly displaced from their maximum upward displacement.
Figure 12:
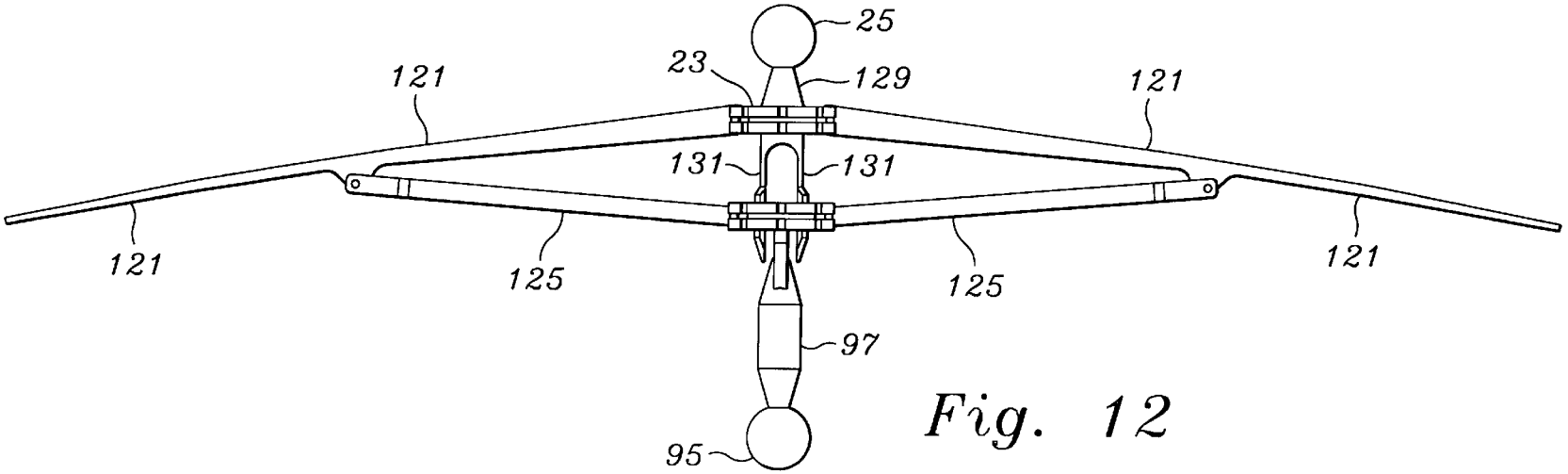
FIG. 12 illustrates a side view of the umbrella assembly seen in FIG. 8 in which the assembly retaining clip hub is shown as disconnected and slightly displaced away from the extender assembly receptacle and in which the umbrella ribs are slightly downwardly displaced from their maximum upward displacement.

Referring to FIGS. 11 and 12, a side view of the umbrella structure 17 as seen in FIG. 8, but again without the material 19, shows the umbrella structure 17 shown in a position either having just begun its closure, or just ending its opening deployment. Note that the fingers 131 have upwardly directed ramped grooves 135 which engage the underside of the rib support structure 149. FIG. 12 illustrates a view from the same perspective as FIG. 11, but where the extender assembly receptacle 141 has been brought into full engagement by the assembly retaining clip hub 21, and the fingers 131 upwardly directed ramped grooves 135 are engaging the underside of the rib support structure 149.

Figure 13:
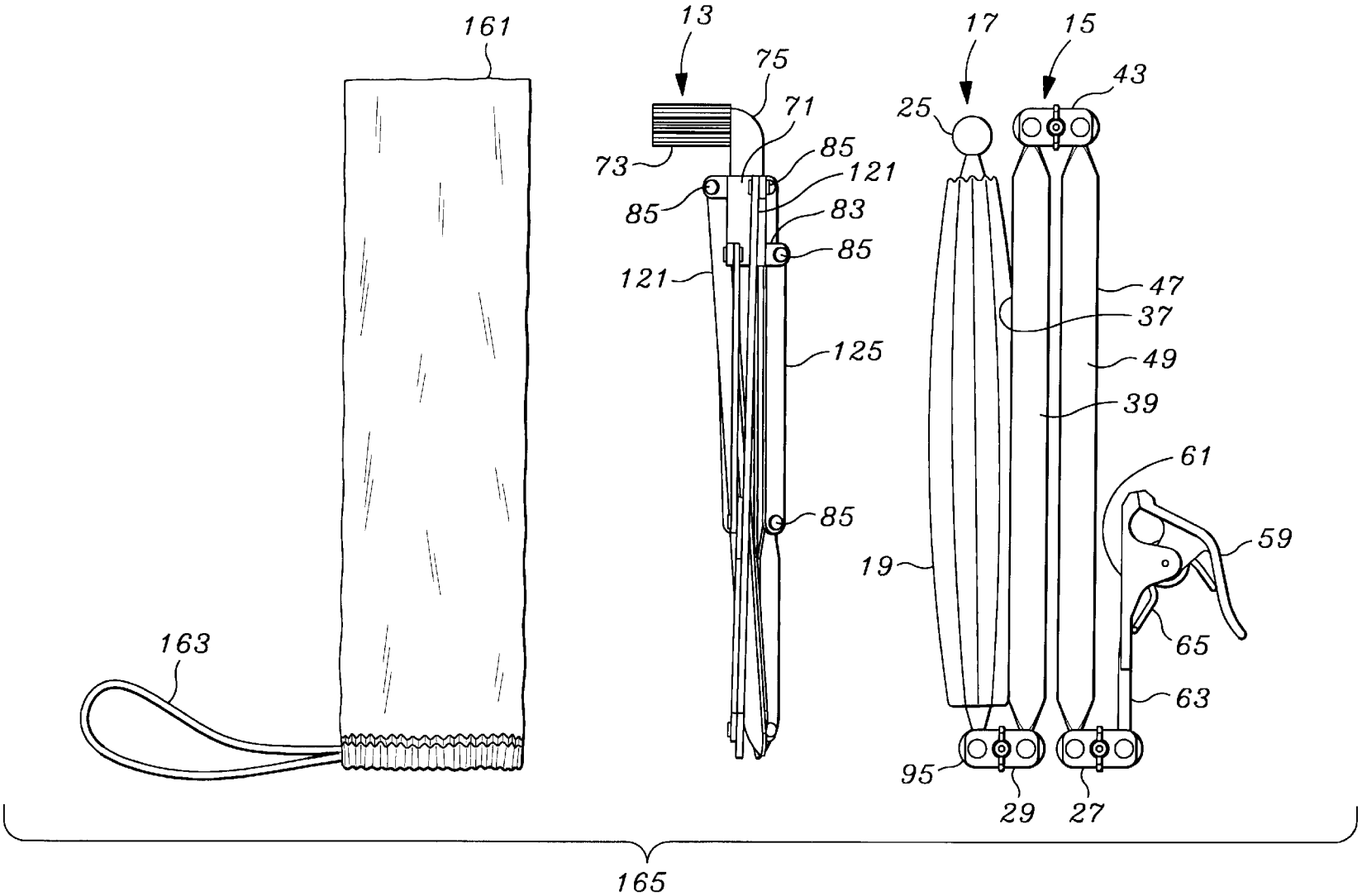
FIG. 13 illustrates the invention in disassembled position with carrying bag forming a kit assembly.

Referring to FIG. 13, the integrated shading structure 11 is seen in folded position. Easily seen is the tripod stand 13, articulating clamping arm 15, and umbrella structure 17. In addition, a storage bag 161 is provided to support all of the tripod stand 13, articulating clamping arm 15, and umbrella structure 17 within its interior and includes a closure/carry drawstring 163. The integrated shading structure 11 is then conveniently available as a handy portable shading structure kit 165.

While the present invention has been described in terms of an shading structure which may be utilized to closely attenuate light and heat from a remote source, one skilled in the art will realize that the structure and techniques of the present invention can be applied to many similar appliances. The present invention may be applied in any situation where close articulating control of a light and heat blocking structure is desired.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A shading structure comprising:

an umbrella structure having:

an assembly retaining clip hub having a pair of spaced apart fingers, each of said fingers having an outwardly disposed ramped groove;

a plurality of outwardly extending umbrella ribs pivotally mounted to said assembly retaining clip hub to fold to an open deployed position and to a closed position;

a plurality of umbrella rib extenders, each one of said plurality of umbrella rib extenders associated with one of said plurality of outwardly extending umbrella ribs, having a first end pivotally connected to its associated umbrella rib, and a second end;

an extender assembly receptacle mounting bracket pivotally connected to said second ends of said umbrella rib extenders, and having an upper bore for accepting said fingers and a hub underside for engagement of said ramped groove, one of said extender assembly receptacle and said assembly retaining clip hub having a first articulating ball;

light blocking material covering and attached to said plurality of plurality of outwardly extending umbrella ribs; an articulating clamping arm comprising:

a plurality of universal arms each having a first end terminating in a first articulating ball and a second end terminating in a second articulating ball;

a clamp having a first pivoting member and a second pivoting member and a transition member terminating in a second articulating ball;

a plurality of pairs of articulating ball retention plates, for joining around pairs of articulating balls to join ones of said first articulating balls to ones of said second articulating balls and to permit rotation and pivoting of at least a first and at least a second pair of said first and second articulating balls with respect to each other and with respect to said articulating ball retention plates; and adjustable tension support, connecting each said pair of articulating ball retention plates, around said pairs of articulating balls, to enable and fix the relationship of said clamp, said plurality of universal arms, and said umbrella structure.

2. The shading structure as recited in claim 1, wherein said clamp is a spring clamp and includes a spring located between said first and said second pivoting members to urge said spring clamp closed.

3. The shading structure as recited in claim 1, wherein each one of said pair of articulating ball retention plates has a pair of apertures bound by a surface matching the external surface of said first and said second articulating balls of said one of said extender assembly receptacle and said assembly retaining clip hub, said plurality of universal arms, and said clamp.

4. The shading structure as recited in claim 1, wherein said pair of articulating ball retention plates each has a bore and wherein said adjustable tension support further comprises:

a joint retention screw having an expanded head and a threaded end extending through said bores of said pair of articulating ball retention plates; and a manually nut, threadably engaged with said threaded end.

5. The shading structure as recited in claim 1, wherein said a plurality of universal arms each have a pair of oppositely disposed flat sides along a most part of their length, and a tapering surface approaching said articulating ball at said first and second ends having a cross sectional dimension no smaller than a distance between said pair of oppositely disposed flat sides.

6. The shading structure as recited in claim 1, wherein said the other of said extender assembly receptacle and said assembly retaining clip hub also has a first articulating ball so that said umbrella structure may be suspended from or supported from beneath by said articulating clamping arm.

7. The shading structure as recited in claim 1, and further comprising a stand having an upper circumferentially ribbed cylindrical member for engagement by said clamp so that said shading structure will be freely supported.

8. The shading structure as recited in claim 7 wherein said stand further comprises:

a body;

a plurality of legs, each having a first end pivotally attached to said body to pivot about a first axis, each of said plurality of legs having an elongate leg slot, and a second end;

a plurality of retaining arms each having a first end pivotally attached to said body to about a second axis, and a second end attached to said elongate slot of an associated one of said plurality of said legs to translate over the extent of said elongate slot, said plurality of legs to achieve a stable and limited deployed position and to be foldable to a collapsed position along said body, along with said retaining arms.

9. The shading structure as recited in claim 8 and further comprising a plurality of stakes each having a first end and a second pointed end, said first end of each of said plurality of stakes pivotably attached to said second ends of said legs to enable deployment to a position to facilitate stabilization of said stand.

10. A shading structure comprising:

an umbrella structure having a top and bottom when deployed in an open position and wherein said umbrella structure further comprises:

an assembly retaining clip hub pivotally supporting a plurality of outwardly extending umbrella ribs pivotable to an open position, each of said umbrella ribs pivotally supported by an associated one of a plurality of extenders which is pivotally supported by an extender assembly receptacle mounting bracket, said receptacle mounting bracket being attached to said assembly retaining clip hub to place said umbrella ribs in an open position and detached from said retaining clip hub to place said umbrella ribs in a folded closed position;

said top of said umbrella structure extending upwardly from said retaining clip hub and said bottom of said umbrella structure extending downwardly from said receptacle mounting bracket; and an articulating clamping arm having a first end pivotally and selectively attaching both said top and said bottom of said umbrella structure and a second end having a clamp for attachment to another structure to give support to said shading structure.

11. The shading structure as recited in claim 10 and wherein said articulating clamping arm further comprises:

a universal arm having a first end terminating in a first articulating ball and a second end terminating in a second articulating ball and wherein said clamp includes a second articulating ball and wherein said umbrella structure has a first articulating ball on at least one of said top and bottom of said umbrella structure a plurality of pairs of articulating ball retention plates, for joining around pairs of articulating balls to join ones of said first articulating balls to ones of said second articulating balls and to permit rotation and pivoting of at least a first and at least a second pair of said first and second articulating balls with respect to each other and with respect to said articulating ball retention plates; and an adjustable tension support, connecting each pair of articulating ball retention plates around said pairs of articulating balls and providing tension to selectively fix the position of said articulating balls with respect to said articulating ball retention plates.

12. The shading structure as recited in claim 10, and further comprising a stand having an upper circumferentially ribbed cylindrical member for engagement by said clamp so that said shading structure will be freely supported.

13. The shading structure as recited in claim 12 and further including an elongate storage bag for enclosing said stand, said umbrella structure and said articulating clamping arm when said stand, said umbrella structure and said articulating clamping arm are in a closed position.

14. The shading structure as recited in claim 12 wherein said stand further comprises:

a body;

a plurality of legs, each having a first end pivotally attached to said body to pivot about a first axis, each of said plurality of legs having an elongate leg slot, and a second end;

a plurality of retaining arms each having a first end pivotally attached to said body to about a second axis, and a second end attached to said elongate slot of an associated one of said plurality of said legs to translate over the extent of said elongate slot, said plurality of legs to achieve a stable and limited deployed position and to be foldable to a collapsed position along said body, along with said retaining arms.

15. The shading structure as recited in claim 14, and further comprising a structure for engaging said clamp and wherein said clamp is a spring clamp.

16. A shading structure comprising:

an umbrella structure having a top and a bottom when deployed in an open position;

an articulating clamping arm having a first end pivotally and selectively attaching one of said top and said bottom of said umbrella structure an a second end having a clamp for attachment to another structure to give support to said shading structure and wherein said articulating clamping arm has at least one articulating joint comprising a first articulating ball connected to a first universal arm, a second articulating ball connected to a second universal arm; and a pair of articulating ball retention plates joining around and securing said first and said second articulating balls with respect to said pair of articulating ball retention plates.

* * * * *